United States Patent [19]

Ducate, Sr.

[11] Patent Number: 5,038,486

[45] Date of Patent: Aug. 13, 1991

[54] MITER GAUGE

[75] Inventor: John S. Ducate, Sr., Columbia, S.C.

[73] Assignee: The J.D.S. Company, Inc., Columbia, S.C.

[21] Appl. No.: 389,379

[22] Filed: Aug. 4, 1989

[51] Int. Cl.[5] ..... B27B 25/10; B43L 7/06

[52] U.S. Cl. ..... 33/430; 83/437; 33/471; 33/497

[58] Field of Search ..... 33/430, 448, 468, 469, 33/471, 495-500, 465, 464, 424; 83/471, 473, 764-767, 422, 437, 438, 435.1, 477.2, 581; 30/481; 417/278, 307, 903; 144/253 R

[56] References Cited

U.S. PATENT DOCUMENTS

| | | | |
|---|---|---|---|
| 1,894,010 | 1/1933 | Tautz | 33/430 X |
| 1,985,614 | 12/1939 | Merrigan | 33/500 |
| 2,237,556 | 4/1941 | Hedgpeth | 33/430 |
| 2,435,928 | 2/1948 | Matulich | 417/903 |
| 2,759,503 | 8/1956 | Goldschmidt | 83/437 X |
| 2,838,078 | 6/1958 | Cusanza | 144/253 R |
| 4,514,909 | 5/1985 | Gilbert | 33/471 |
| 4,593,590 | 6/1986 | Gray | 83/477.2 X |
| 4,658,686 | 4/1987 | Woods | 83/437 X |
| 4,741,387 | 5/1988 | Strong | 83/437 X |
| 4,798,113 | 1/1989 | Viazanko | 83/473 |

FOREIGN PATENT DOCUMENTS 2419573 11/1974 Fed. Rep. of Germany ..... 417/903

OTHER PUBLICATIONS

Sales Brochure of Injecta Machinery Corp. for Model 2100 Professional Precision Cabinetmakers 12" Tilt-Arbor Table Saw Sales Brochure of Masterpiece Machines.

Ibid, *Miter Group/Clamp Attachment* P/N 34-895, 34-568 and 34-873.

*Primary Examiner*—Harry N. Haroian

*Attorney, Agent, or Firm*—Pollock, Vande Sande & Priddy

[57] ABSTRACT

Miter apparatus for use with a cutting tool having a table top containing an alignment groove. The miter apparatus includes a guide bar adapted to slidably fit in the alignment groove, a head assembly pivotally secured to the guide bar, and a telescopic fence assembly secured to the head assembly. The fence assembly is adjustable in length and includes an inner rail telescopically received within an outer rail, each rail being provided with a retractable workpiece stop which is pivotally mounted on its rail so as to be movable from an operative to a retracted position. A clamping mechanism may be provided for securing a workpiece in position against the guide bar.

29 Claims, 4 Drawing Sheets

FIG. 3
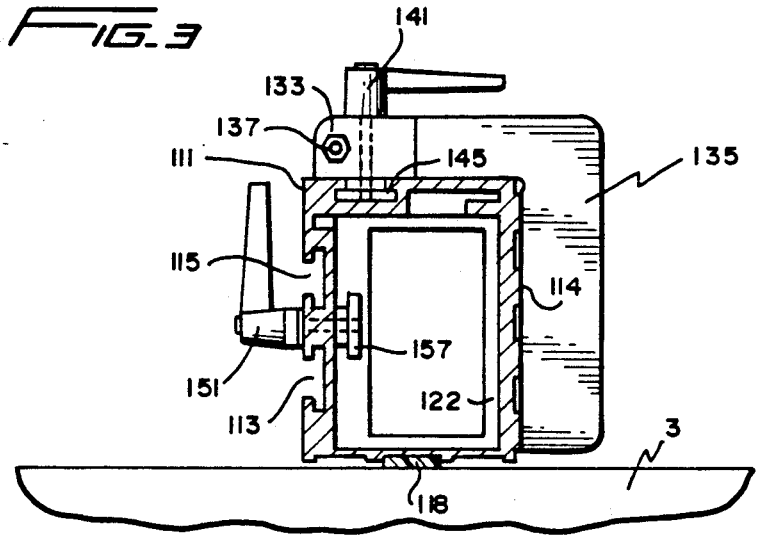
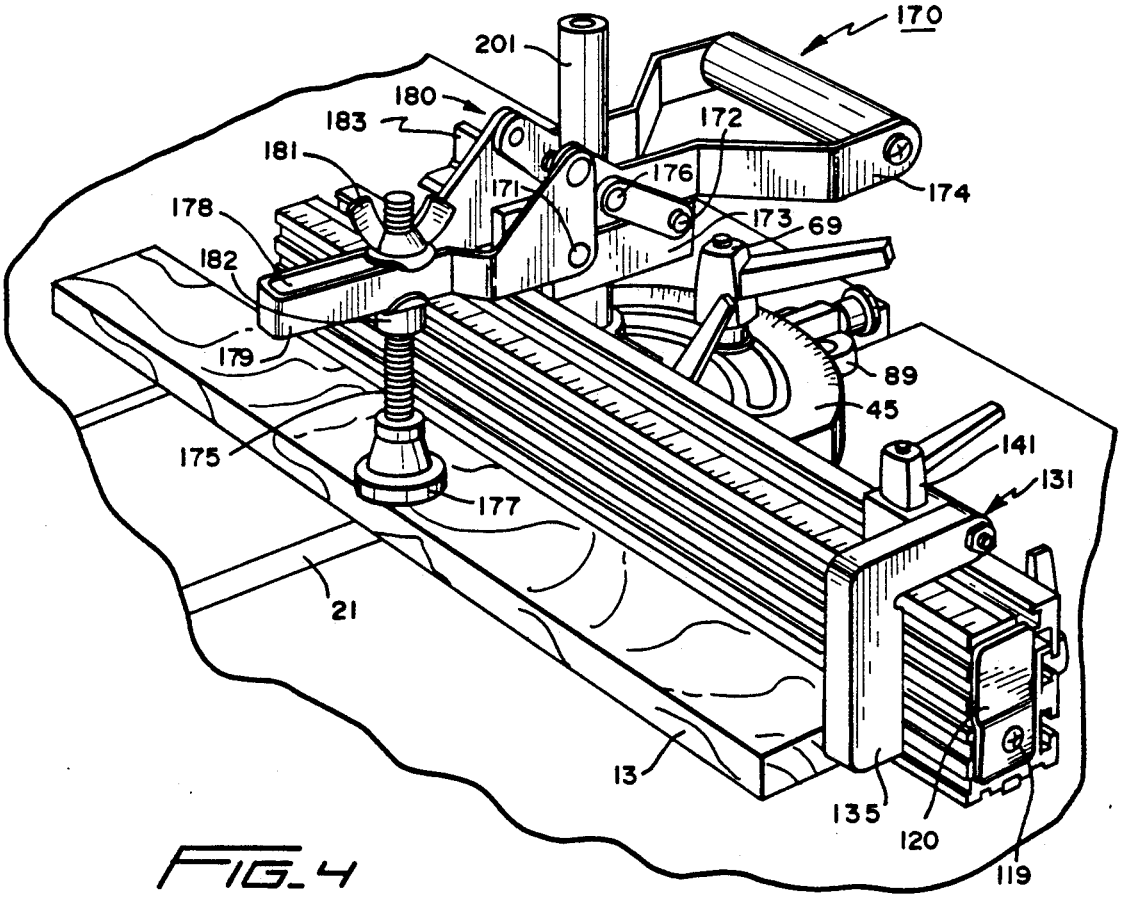
FIG. 4

MITER GAUGE

FIELD OF THE INVENTION

The present invention relates in general to apparatus for accurately positioning a work piece in relation to a working tool, and relates more particularly to miter gauges for table saws and other cutting or shaping tools, such as those used in woodworking.

BACKGROUND OF THE INVENTION

Miter gauges for positioning workpieces, such as lengths of lumber, on a table are known in the art; however, the typical known gauges are not sufficiently versatile to meet the wide variety of needs which are encountered by workers faced with the problems of accurately and quickly cutting workpieces at a variety of angles and to a variety of lengths.

SUMMARY OF THE INVENTION

It is accordingly one object of the present invention to provide an improved miter gauge for use with table-mounted working tools. Other objects of this invention are to provide a miter gauge having means for quickly adjusting the position of a stop element for a workpiece, an improved fence arrangement, and an improved workpiece clamping element.

It is yet another object of this invention to provide a miter gauge which is capable of rapid and accurate adjustment for varying the angle and/or length of a workpiece to be cut.

In accordance with this invention, there is provided a miter gauge for use with a table having a working tool wherein the table top is provided with a straight groove extending substantially the length thereof in the top surface. The miter gauge is adapted to move along the table top in the longitudinal direction of the groove, and comprises: a guide bar adapted to fit into and move longitudinally within the groove; a head assembly pivotally secured to the guide bar means and having a base portion for engaging the working surface of the work table and a fence-engaging portion extending upwardly from the base portion; pivot restriction means for securing the head assembly at any one of a plurality of angular positions with respect to the guide bar means; and a telescopic fence secured to the head assembly.

In another aspect of this invention the miter gauge comprises guide bar means; head assembly means pivotally secured to the guide bar means and having a base portion for engaging the surface of the work table and a fence-engaging portion extending upwardly from the base portion; pivot restriction means for securing the head assembly means at any one of a plurality of angular positions with respect to the guide bar means; fence means secured to the fence-engaging portion of the head assembly means for contacting a workpiece; and clamping means mounted on said head assembly means for retaining the workpiece in a fixed position relative to the fence means and the guide bar means.

The word "telescopic" is intended to mean a fence means comprising at least two sections, one of which is at least partially nested within and longitudinally movable with respect to another section. As shown and described herein the telescopic fence means includes an outer rail having a passageway extending along at least a portion of the length thereof, an inner rail movably positioned within the passageway of the outer rail, means for securing the outer rail on said head assembly means in a plurality of laterally extending positions with respect to the guide bar means, and means for securing the inner rail in a plurality of longitudinally extending positions with respect to the outer rail. The passageway in the outer rail preferably extends along a major portion of the overall length of the outer rail, more preferably along substantially the entire length thereof, and preferably the length of the inner rail is substantially equal to the length of this passageway.

In the preferred form of the invention, the miter gauge is provided with one or more of the following features:

1) means for retaining the guide bar means within the groove in the table top;

2) retractable workpiece stops on both the inner and outer rails;

3) indexing pin means for latching the head assembly means in any one of a plurality of preselected angular positions;

4) a longitudinally extending wear strip of high molecular weight plastic on the surface of the outer rail which faces the work surface of the table; and, 5) easily actuated clamping means for securely clamping a workpiece against the guide bar means and in abutment with the fence means.

Highly accurate cuts, both to the desired length and at the desired angle can be achieved with the miter gauge of the present invention. In addition, changes can be made quickly both as to length and angle by merely loosening hand operated clamps, making a desired adjustment, and then tightening the loosened clamps.

BRIEF DESCRIPTION OF THE DRAWINGS

FIG. 3 is an elevational side view of the telescopic fence component in section taken along lines 3—3 of FIG. 1.

FIG. 4 is a perspective view of the invention including a manually operated clamp for holding a workpiece in position relative to a table saw.

DETAILED DESCRIPTION OF THE INVENTION

The best mode embodiments of the miter gauge of the present invention are described below in detail in combination with a circular table saw. However, this miter gauge may also be used in combination with other work tools, such as for example band saws, jig saws, saber saws, dado heads, router tables, sanders, and shapers of various types.

Figure 1:
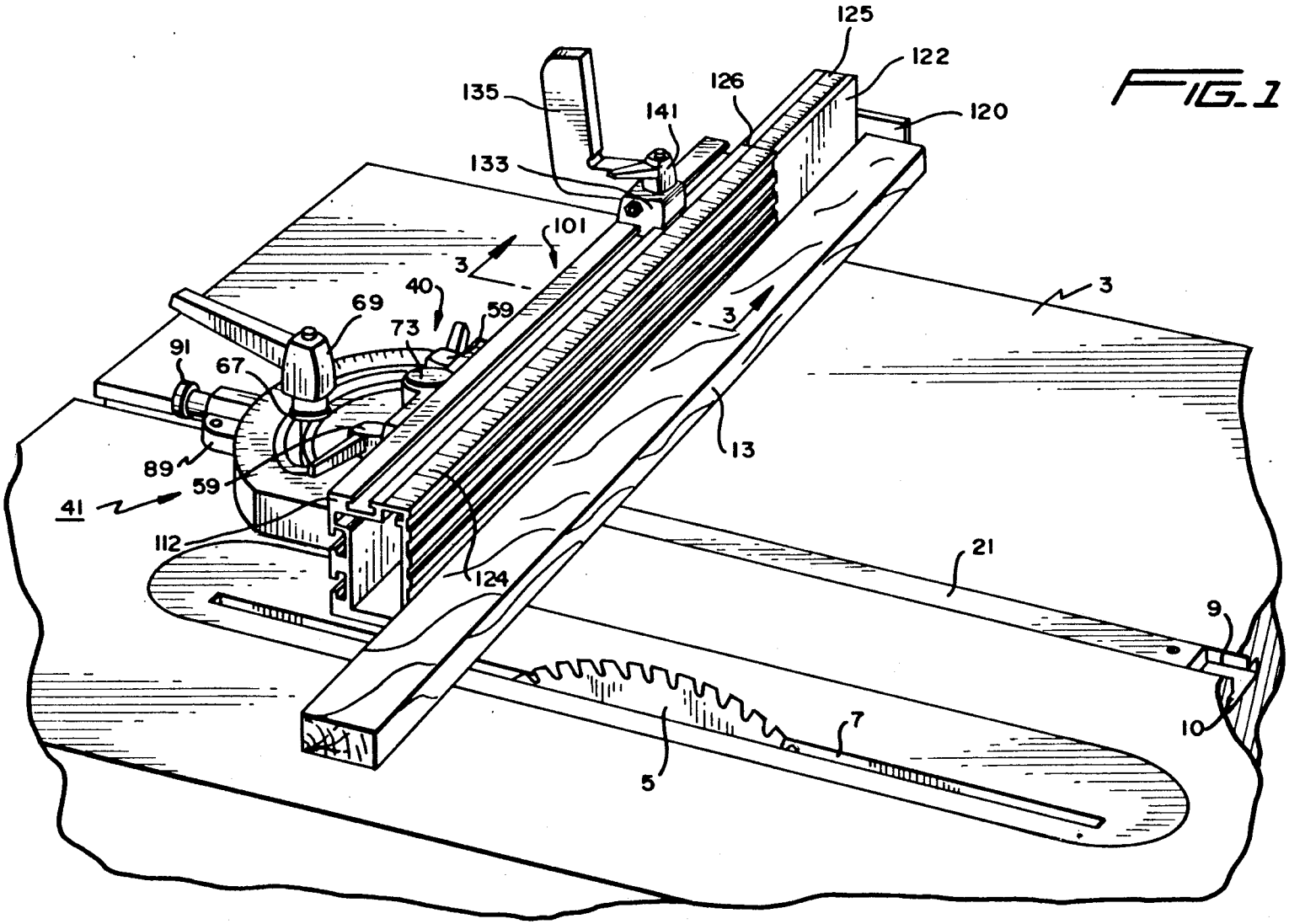
FIG. 1 is a perspective view showing one embodiment of the present invention which is mounted on a table saw.

Referring now to the drawings, the miter gauge 40 of the present invention, as shown in FIG. 1, is mounted on table top 3 of a table saw and comprises a head assembly 41, a telescoping fence assembly 101, and a guide bar 21. Guide bar 21 fits within an alignment groove 9 in table top 3. Alignment groove 9 is preferably undercut at 10 to provide an inverted T-shaped cross section. A slot 7 in table top 3, and a circular saw blade 5 which extends upwardly through slot 7, are parallel to the alignment groove 9.

Figure 2:
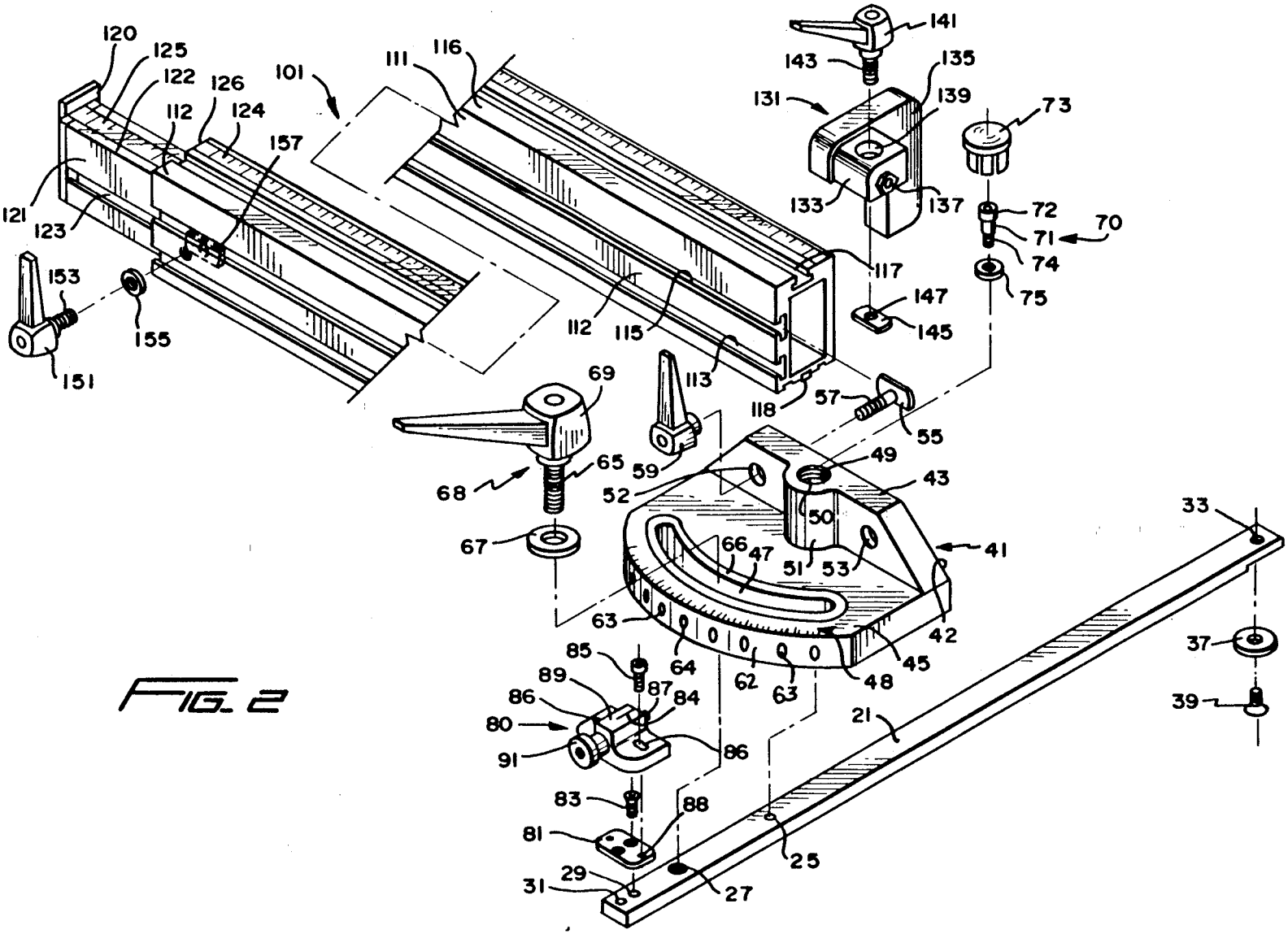
FIG. 2 is an exploded view of the embodiment of FIG. 1.
Figure 5:
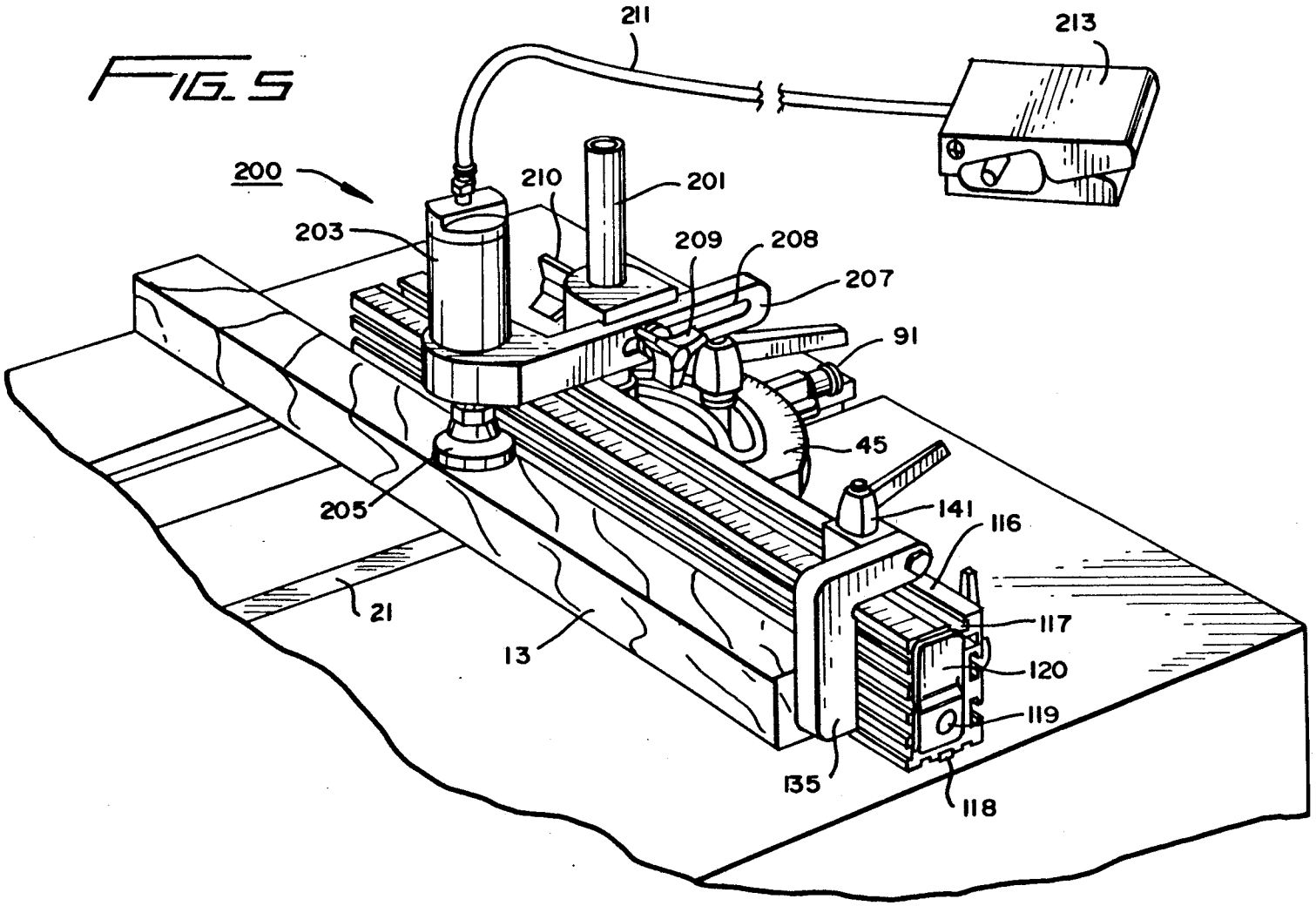
FIG. 5 is a perspective view of the invention including a foot-operated pneumatically-powered clamp for holding a workpiece in position relative to a table saw.

Head assembly 41, as shown in FIG. 2, comprises a base portion 45, a friction locking means 68 and a head latching means 80. Head assembly 41 is pivotally secured to guide bar 21 by a pivot pin 70 which passes through a bore 50 in a boss 51 on a vertical wall 43 of head assembly 41 and screws into a threaded opening 25 in guide bar 21. A washer 75 is forced by head 72 of pin 70 against an annular shoulder (not shown) within bore 50, and a shank portion 71 of larger diameter than threaded portion 74 thereby pivotally connects head assembly 41 to guide bar 21. Bore 50 is provided with threads 49 to receive a post 201, as seen in FIGS. 4 and 5, which is adapted for use with means for clamping a workpiece so that it is retained in place against the upper surface of guide bar 21 for movement with head assembly 41 across the table top surface. A removable cap 73 protects the threaded portion 49 of bore 50 when post 201 is not being used.

As used in this specification, the term "alignment groove" refers to any elongated groove in a table top for receiving a guide bar. The alignment groove may have any cross section appropriate for receiving the cross-sectional shape of the guide bar, such as rectangular. However, in the preferred embodiment of the invention shown in the drawings, the alignment groove is undercut, as exemplified by grooves having a trapezoidal or an inverted T-shaped cross section, to accommodate means for positive retention of the guide bar in the alignment groove. Thus, as shown in FIG. 2, guide bar 21 may be provided at its distal end with a washer-like retaining element 37 for use with inverted T-shaped and other undercut grooves. Retaining element 37, which is preferably made of a low-friction plastic such as Teflon, is held in place on guide bar 21 by bolt 39 which in turn screws into a threaded opening 33 in guide bar 21. Retaining element 37 fits in and engages the undercut portion 10 of inverted T-shaped groove 9 and thereby prevents guide bar 21 from being raised out of groove 9 in the event, for example, that the head assembly is moved backwards beyond the edge of table top 3.

Base portion 45 of head assembly 41 is provided with an arcuate slot 47 which is substantially concentric with bore 50 whereby head assembly 41 may be pivoted about pin 70. Head assembly 41 may be secured in any desired angular position within the range defined by slot 47 by operation of either friction locking means 68 or head latching means 80. Friction locking means 68 comprises a washer 67, a lock handle 69 having a threaded portion 65 which passes through washer 67 and arcuate slot 47, and a threaded opening 27 in guide bar 21 for engaging threaded portion 65. Head assembly 41 is secured against pivoting by turning handle 69 to force washer 67 downwardly against a bearing surface 66 on base portion 45.

Head latching means 80 cooperates with pin openings 63 in an arcuate wall 62 of base portion 45 so as to latch head assembly 41 at predetermined angles of fence means 101 with respect to guide bar 21. A latch housing 89 is marked with a pointer line 84 and the upper surface of base portion 45 adjacent to arcuate slot 47 is marked with a scale 48 comprising angular gradations. These markings provide an indexing means for setting the angle of fence means 101 at the angles of pin openings 63 and at intermediate angles therebetween. The values of the angles corresponding to the openings 63 are preferably imprinted on the upper surface of base 45 adjacent to the corresponding indicia of scale 48, and these imprinted values are preferably 0°-90° at center opening 64, 15°-75° at the first openings to either side of center, 22.5° at the second openings to either side of center, 30°-60° at the third openings to either side of center, and 45° at the fourth openings to either side of center. The total arc provided by slot 47 is preferably about 100 degrees, i.e., about 50 degrees to either side of center opening 64. The dual angular markings, such as 0°-90°, are to satisfy the different conventions of craftsmen wherein some consider a straight cross cut as being at 0 degrees while others consider this as being at 90° (perpendicular to the elongated workpiece 13).

As shown in FIG. 2, a shot pin 87 is carried within a housing 89 and may be retracted against the force of a spring (not shown) by a knob 91 and released into any one of the openings 63 to obtain a desired angular orientation of the workpiece 13 relative to cutting saw 5. Bolts 85 (only one being shown), which secure housing 89 to a plate 81, pass through slotted holes 86—86 and are screwed into threaded holes 88. Plate 81 in turn is secured to guide bar 21 by countersunk bolts 83 (only one being shown) which screw into threaded openings 29 and 31 in guide bar 21. Slotted holes 86-86 permit small sideways adjustments of housing 89 to square fence assembly 101 relative to the alignment axis defined by the direction of movement of guide bar 21 and thereby set the center (0°-90°) position of head assembly 41.

Fence assembly 101 is secured to a forward surface 42 of vertical wall 43 of head assembly 41 by bolts 57 (only one of which is shown) which pass through openings 52 and 53 in wall 43. Wall 43 thereby serves as a fence engaging portion of the head assembly. Bolt 57 screws into a tapped lock handle 59 and includes a flat plate member 55 which serves as a bolt head and fits into a T-shaped slot 115 in an outer rail 112. The use of two lock handles 59—59 as shown in FIG. 1 to secure head assembly 41 to outer rail 112 prevents the outer rail from pivoting relative to the head assembly. A second T-shaped slot 113 may be provided for securing the fence assembly to the head assembly in order to raise the fence assembly so that it can rest on an underlying part of a workpiece.

Telescopic fence assembly 101 comprises the outer rail 112, an inner rail 122, a workpiece stop assembly 131 for the outer rail and a workpiece stop 120 for the inner rail. Outer rail 112 also is provided with a vertical front wall 114, a vertical rear wall 111, and a T-shaped slot 117 in a horizontal top wall 116 connecting the front and rear walls. Inner rail 122 is provided with a longitudinally extending T-shaped slot 123 in a rear vertical wall 121. The inner rail 122 is adjustably secured in different positions with respect to the outer rail 112 by a lock handle 151 having a threaded portion 153 which passes through a washer 155 and engages a flat clamping member 157 positioned in slot 123. When lock handle 151 is tightened, an increase in the friction between the inner and outer rails restricts their relative longitudinal movement.

As shown in FIG. 3, outer rail 112 is preferably provided on its bottom with a strip 118, which is made from an ultra high molecular weight polymer to reduce friction between the fence assembly and the table top 3. Suitable ultra high molecular weight polymer strips, which have a pressure sensitive adhesive on one surface for attachment to the bottom side of the outer rail, are available from Atlantic Plastics of Columbia, South Carolina.

Mounted in slot 117 of outer rail 112 is the end stop assembly 131 to provide a retractable stop for workpieces. As shown best in FIG. 2, stop assembly 131 is longitudinally adjustable along slot 117 and may be retained in any desired position along outer rail 112 by operation of lock handle 141 which has a threaded portion 143 passing through an opening 139 in a base 133 and screwing into a threaded opening 147 in a flat clamping member 145. Clamping member 145 can be moved along T-shaped slot 117 until it reaches a desired position, at which place it may be secured by tightening lock handle 141. L-shaped stop member 135 is pivoted about a bolt 137 with respect to base 133 so as to be retractable. When the L-shaped member 135 is pivoted out of the way, workpieces to be cut can extend beyond the end of the outer rail that is away from the cutting tool.

Inner rail 122 serves as an end stop for workpieces longer than outer rail 112, and is provided with a retractable stop 120 which is pivotable about a bolt 119 as shown best in FIGS. 4 and 5. As may be seen in FIG. 4, stop 120 is pivoted to an up position when not in use, and is pivoted to a down position as shown in FIG. 1 to fix the position of the outer end of a workpiece longer than outer rail 112. The longitudinal adjustability of the inner rail relative to the outer rail permits a fixed stop element at the outer end of the inner rail to provide a wide range of extended stop adjustments. Scales 124 and 125 of length indicia along the outer and inner rails, respectively, indicate the length of the cut workpiece, adjustable stop member 135 serving as a pointer along scale 124 and the outer end 126 of outer rail 112 serving as a pointer along scale 125. Quick and accurate positioning of stops 131 and 120 is achieved by the presence of scales 125 and 124 on the inner and outer rails, respectively, and the use of threaded lock handles 141 and 151 for making the desired length adjustments of the workpiece 13 relative to the plane of saw 5.

Lock handles as shown at 59, 69, 141 and 151 are referred to as "Elesa Adjustable Handles" and are available commercially from Jergens, Inc., of Cleveland, Ohio. These handles are especially useful when the operating angle is limited because their locking position can be adjusted during the locking operation by lifting and turning the handle to reposition the locking mechanism. This action first disengages teeth from an internal locking element and then an internal return spring automatically re-engages the teeth in a new locking position.

In a preferred embodiment of the present invention, clamping means are provided for retaining a workpiece against the top surface of the guide bar, and preferably such means are mounted on the head assembly 41, and most preferably are mounted coaxially with the pivot point of the head assembly relative to the guide bar. Preferably the clamping means directs a downward clamping force against a workpiece directly above guide bar 21.

FIG. 4 shows a manual clamping assembly 170 mounted on post 201 to clamp the workpiece 13 and retain it against guide bar 21. As shown in FIG. 4, the clamp assembly comprises a toggle mechanism 180 pivotally mounted at pins 171 and 172 on a vertically sliding base 173, which may be moved upward or downwardly on post 201 and retained in a desired position by tightening a knob 183. Movement of handle 174 downwardly moves U-shaped arm 179 downwardly, resulting in corresponding downward movements of threaded bolt 175 and pressure pad 177. When downward motion of pad 177 is resisted by the workpiece 13, toggle mechanism 180 retains the downward force of pad 177 against the workpiece by an over-center lever action of pin 176 relative to pin and the pivot connection between arm 179 and handle 174 as shown in FIG. 4. The downward force exerted by the pressure pad may be released by an upward force on handle 174. Pressure pad 177 is positioned directly above guide bar 21 and may be adjusted longitudinally by rotating bolt 175 relative to a threaded collar 182, which causes bolt 175 to move transversely through a slot 178 defined by U-shaped arm 179. Pressure pad 177 may be adjusted laterally relative to the fence assembly by movement of bolt 175 in or out along slot 178. Pad 177 and bolt 175 are held in place relative to arm 179 by tightening a wing nut 181.

A foot pedal-actuated pneumatic device 200 for clamping the workpiece 13 in position is shown in FIG. 5. Externally supplied compressed air is routed through a valve means operated by a foot pedal 213 to a pneumatic cylinder 203 via an air hose 211, thereby causing a piston (not shown) to move downwardly and urge pressure pad 205 against workpiece 13. The cylinder and pressure pad are secured in a desired vertical position on post 201 by tightening a handle 210, and in a suitable transverse position relative to the fence assembly by adjustment of an arm 207 having a slot 208 through which passes the bolt of a tightening handle 209. In a preferred embodiment of this pneumatic clamping means, the valve means provided in foot pedal 213 deactivates the clamp when foot pressure is removed.

The material from which the various components are made is not critical and suitable materials may readily be selected by workers in the art. Zinc alloys are well-suited for the base and wall portions of the head assembly, the housing of the latch assembly, and the stop and base of the stop assembly 131. The inner and outer rails of the fence assembly are preferably made by extrusion of an aluminum alloy, while steel alloys are best-suited for the guide bar.

The embodiments described herein are for the purpose of illustrating the present invention, and workers skilled in the art will recognize variations thereof that fall within the scope of this invention which is limited only by the claims appended hereto and equivalents of the features described therein.

What is claimed is:

1. A miter gauge for a work tool apparatus which includes a cutting blade and a work table fixed relative to the cutting blade, said work table having an alignment groove in a work surface thereof, said miter gauge comprising:

guide bar means for fitting within and for moving longitudinally along said alignment groove;

head assembly means having a base means for engaging an upper surface of said guide bar means and a fence-engaging means mounted on said base means and extending away from said upper surface, said head assembly means being pivotally connected to said guide bar means;

telescopic fence means secured to said fence-engaging means and having a workpiece engaging surface for engaging a side surface of a workpiece, said fence means comprising a main rail, an extensible rail extendable relative to an end of said main rail, and clamping means for adjustably securing said extensible rail at any one of a plurality of difference extended positions with respect to said end of the main rail, one of said rails being an outer rail and the other of said rails being an inner rail telescopically nested within at least a portion of said outer rail such that said rails are extendable relative to one another along a common axis to position both of said rails opposite said side surface of the workpiece when said side surface is engaged by said workpiece engaging surface and extends beyond said end of the main rail;

pivot restriction means for detachably securing said head assembly means and said guide bar means to each other at any one of a plurality of positions such that said fence means may be held in different predetermined angular positions with respect to said guide bar means; and, support means carried by said fence means for engaging said work surface to support said outer ail for transverse movement in spaced relation to said work surface as said guide bar means moves along said alignment groove of the fixed work table.

2. A miter gauge according to claim 1 wherein said pivot restriction means comprises a latch assembly mounted on said guide bar means and having an indexing pin, and a plurality of angularly displaced, indexing holes provided in a member of said base means and adapted to receive said indexing pin for holding said base member in different predetermined angular positions with respect to said guide bar means.

3. A miter gauge according to claim 2 wherein said pivot restriction means further comprises an arcuate slot within said base member and bolt means extending through said slot and secured to said guide bar means for clamping said base member in different angular positions between said predetermined angular positions provided by said indexing holes.

4. A miter gauge according to claim 1 wherein said telescopic fence means further comprises a stop means carried by said extensible rail for engaging an end surface of the workpiece.

5. A miter gauge according to claim 1 wherein said main rail is provided with a main stop means longitudinally movable along said main rail, and said main stop means comprises a stop element for engaging an end surface of the workpiece and stop clamping means for fixing said workpiece stop element at any one of a plurality of different positions along said main rail.

6. A miter gauge according to claim 5 wherein said stop means of said main rail includes means for moving said stop element between a workpiece engaging position and a retracted position preventing engagement of said workpiece.

7. A miter gauge according to claim 1 wherein said outer rail is the main rail and said inner rail is the extensible rail, said inner rail and said outer rail are each provided with length measuring means, and said outer rail comprises means serving as a pointer along a scale of the length measuring means of the inner rail to indicate different lengths for cutting the workpiece.

8. A miter gauge according to claim 1 wherein said support means comprises a support element mounted on the underside of said outer rail, said support element having a friction-reducing surface for slidably engaging said work table.

9. A miter gauge according to claim 8 wherein said friction reducing support element comprises a strip of ultra-high molecular weight polymer.

10. A miter gauge according to claim 1 wherein said head assembly means is provided with clamping means for retaining a workpiece against said guide bar and in abutment with at least a portion of said fence means.

11. A miter gauge according to claim 10 wherein said clamping means comprises a longitudinally and laterally movable clamping member, and means for exerting a force biasing said clamping member toward said workpiece and said guide bar.

12. A miter gauge according to claim 1 further comprising main clamping means for adjustably securing said main rail at any one of a plurality of different extended positions relative to said head assembly means.

13. A miter gauge according to claim 1 wherein said outer rail is the main rail and is provided with a longitudinally-extending undercut slot for engagement by a main clamping means of said head assembly means, said main clamping means including means for slidably engaging said undercut slot for securing said outer rail at any one of a plurality of different extended positions relative to said head assembly means.

14. A miter gauge for a work tool apparatus which includes a cutting blade and a work table fixed relative to the cutting blade, said work table having an alignment groove in a work surface thereof, said miter gauge comprising:

guide bar means for fitting within and for moving longitudinally along said groove;

head assembly means comprising a base means for engaging an upper surface of said guide bar means, and a fence-engaging portion carried by said base means and extending away from said upper surface, said head assembly means being pivotally secured to said guide bar means;

fence means having a workpiece engaging surface and comprising a main rail engaged by said frame engaging portion and extendable relative to an end of said head assembly means, an extensible rail carried by said main rail and extendable relative to an end of said main rail to position both of said rails opposite a side surface of a workpiece when said side surface is engaged by said workpiece engaging surface and extends beyond said end of the main rail, and first clamping means for securing said extensible rail to said main rail at any one of a plurality of different extended positions with respect to said end of the main rail;

second clamping means for securing said main rail to said fence engaging portion at any one of a plurality of different extended positions with respect to said end of said head assembly means; and, support means carried by said fence means for engaging said work surface to support said main rail for transverse movement in spaced relation to said work surface as said guide bar means moves along said alignment groove of the fixed work table.

15. A miter gauge according to claim 14 wherein said main rail is an outer rail, and said extensible rail is an inner rail telescopically nested within at least a portion of said outer rail.

16. A miter gauge according to claim 14 wherein said main rail provides said workpiece engaging surface; wherein said main rail has an opposed surface engaged by the fence-engaging portion of said head assembly means, and a connecting surface joining said opposed surface and said workpiece engaging surface, said connecting surface containing a longitudinally-extending undercut slot; and wherein said fence means further comprises workpiece stop means slidably engaged in said undercut slot, said stop means comprising housing means, a stop element pivotally mounted on said housing means for pivotal movement toward and away from a stop position adjacent to the workpiece engaging surface of said fence means, and means carried by said housing means for engaging said undercut slot to fix said stop means at any one of a plurality of different positions along said main rail.

17. A miter gauge according to claim 16 wherein said main rail is provided with a length measuring scale, and said stop means cooperates with said scale such that said stop element serves as a pointer movably along said scale to indicate different lengths for cutting a workpiece.

18. A miter gauge according to claim 14 wherein said main rail is provided with workpiece stop means comprising a stop element for engaging an end surface of the workpiece, positioning means for fixing said workpiece stop element at any one of a plurality of different positions along the length of said main rail, and means for moving said stop element between a workpiece engaging position and a retracted position preventing engagement with said workpiece.

19. A miter gauge according to claim 18 wherein said main rail and said extensible rail are each provided with length measuring means, wherein said main rail comprises means serving as a pointer along a scale of the length measuring means of the extensible rail to indicate different lengths for cutting the workpiece when said side surface of the workpiece extends beyond said end of the main rail, and wherein said stop means is movable longitudinally along said main rail and comprises means serving as a pointer along a scale of the length measuring means of the main rail when the stop element of said stop means is in its workpiece engaging position.

20. A miter gauge for a work tool apparatus including a work table having an alignment groove in a work surface thereof for receiving guide bar means which fits within and moves longitudinally along said alignment groove, said miter gauge comprising:

head assembly means having a base means for engaging said work surface and a fence-engaging means mounted on said base means and extending away from said work surface, said head assembly means including means for pivotally connecting said base means to said guide bar means for rotation of said head assembly means about an axis;

fence means secured to said fence-engaging means for rotation with said head assembly means, said fence means having a surface for engaging a workpiece;

pivot restriction means for detachably securing said head assembly means to said guide bar means at any one of a plurality of different pivotal positions about said axis of rotation such that said fence means may be held in different predetermined angular positions with respect to said guide bar means; and, workpiece clamping means mounted on said head assembly means and extending over said fence means for providing a downwardly directed clamping force for retaining said workpiece in a fixed position against said guide bar means and against said workpiece engagement surface, said workpiece clamping means comprising a pneumatic actuator, a vertically movable pressure pad positioned opposite to said guide bar means, and pneumatic pressure means for causing said pressure pad to be biased against a workpiece positioned between said pressure pad and said guide bar means in response to operation of said actuator.

21. A miter gauge according to claim 20 wherein said workpiece clamping means is mounted on said head assembly means coaxially with said means pivotally connecting said base means to said guide bar means.

22. A miter gauge for a work tool apparatus including a work table which has an alignment groove in a work surface thereof, said miter gauge comprising:

guide bar means for fitting within and for moving longitudinally along said alignment groove in a direction defining an alignment axis;

head assembly means having a base means for engaging said work surface and a fence-engaging means mounted on said base means and extending away from said work surface, said base means being pivotally connected to said guide bar means;

fence means secured to said head assembly means by said fence-engaging means and having a surface for engaging a workpiece; and, pivot restriction means for detachably securing said head assembly means and said guide bar means to each other at any one of a plurality of different positions such that the workpiece engaging surface of said fence means may be held in different predetermined angular positions with respect to said alignment axis, said pivot restriction means comprising a latch assembly mounted on said guide bar means and having an indexing pin, a plurality of angularly displaced indexing holes provided in said base means and adapted to receive said indexing pin for holding said base means in different latched positions corresponding to said different predetermined angular positions, one of said latched positions being a reference position corresponding to a reference angle between said workpiece engaging surface and said alignment axis, and means for providing sideways adjustment of said indexing pin relative to said guide bar means to align said base means with said guide bar means so that said reference angle is the true angle between said workpiece engaging surface and said alignment axis when said indexing pin holds said base means in said reference position.

23. A miter gauge according to claim 22 wherein said pivot restriction means further comprises an arcuate slot within said base means and bolt means extending through said slot and secured to said guide bar means for clamping said base means in different angular positions between the predetermined angular positions provided by said indexing holes.

24. A miter gauge for a work tool apparatus which includes a cutting blade and a work table fixed relative to the cutting blade, said work table having an alignment groove in a work surface thereof, said miter gauge comprising:

guide bar means for fitting within and for moving longitudinally along said alignment groove;

head assembly means having a base means for engaging an upper surface of said guide bar means, and a fence-engaging means mounted on said base means and extending away from said upper surface, said head assembly means being pivotally connected to said guide bar means;

fence means secured to said head assembly means by said fence-engaging means and having a workpiece engaging surface for engaging a side surface of a workpiece, said fence means comprising a main rail, an extensible rail extendable relative to an end of said main rail when said side surface is engaged by said workpiece engaging surface and extends beyond said end of the main rail, and clamping means for securing said extensible rail at any one of a plurality of different extended positions with respect to said end of the main rail;

first stop means movable longitudinally relative to said main rail, said first stop means comprising a stop element for engaging an end surface of the workpiece, means for fixing said stop element at any one of a plurality of different longitudinal positions relative to said main rial, and means for moving said stop element between a workpiece engaging position and a retracted position preventing its engagement with said workpiece;

second stop means carried by said extensible rail for engaging said end surface of the workpiece when the stop element of said first stop means is in its retracted position and said side surface of the workpiece extends beyond said end of the main rail; and, support means carried by said fence means for engaging said work surface to support said outer rail for transverse movement in spaced relation to said work surface as said guide bar means moves along said alignment groove of the fixed work table.

25. A miter gauge according to claim 24 wherein one of said rails is an outer rail and the other of said rails is an inner rail telescopically nested within at least a portion of said outer rail such that said rails are extendable relative to one another along a common axis to position both of said rails opposite said side surface of the workpiece when said side surface is engaged by said workpiece engaging surface and extends beyond said end of the main rail.

26. A miter gauge according to claim 24 further comprising pivot restriction means for detachably securing said head assembly means and said guide bar means to each other at any one of a plurality of different positions such that said fence means may be held in different predetermined angular positions with respect to said guide bar means.

27. A miter gauge according to claim 24 wherein said main rail and said extensible rail are each provided with length measuring means, wherein said main rail comprises means serving as a pointer along a scale of the length measuring means of the extensible rail to indicate different lengths for cutting the workpiece when said side surface of the workpiece extends beyond said end of the main rail, and wherein said first stop means is movable longitudinally along said main rail and comprises means serving as a pointer along a scale of the length measuring means of the main rail when the stop element of said first stop means is in its workpiece engaging position.

28. A miter gauge for a work tool apparatus including a work table having an alignment groove in a work surface thereof for receiving guide bar means which fits within and moves longitudinally along said alignment groove, said miter gauge comprising:

head assembly means having a base means for engaging said work surface and a fence-engaging means mounted on said base means and extending away from said work surface, said head assembly means including means for pivotally connecting said base means to said guide bar means for rotation of said head assembly means about an axis;

fence means secured to said head assembly means by said fence-engaging means for rotation with said head assembly means, said fence means having a surface for engaging a workpiece;

pivot restriction means for detachably securing said head assembly means to said guide bar means at any one of a plurality of different positions such that said fence means may be held in different predetermined angular positions which respect to said guide bar means; and, workpiece clamping means mounted on said head assembly means and extending over said fence means for providing a downwardly directed clamping force for retaining said workpiece in a fixed position against said guide bar means and against said workpiece engaging surface, said clamping means comprising a clamping member having one end portion pivotally connected to said head assembly means and another end portion positioned for reciprocal movement relative to said guide bar means, an actuator member having a handle means and connected to said clamping member by a first pivot connection for causing said reciprocal movement, a pressure member positioned opposite to said guide bar means and mounted on said another end portion of the clamping member for clamping movement therewith from a releasing position into a clamping position for clamping said workpiece between said pressure member and said guide bar means when a downward force is applied to said handle means, and a lever member connected to said head assembly means by a second pivot connection and to said actuator member by a third pivot connection, said third pivot connection having an over-center position relative to said first and second pivot connections for causing said pressure member to remain in said clamping position and maintain a clamping force against said workpiece after removal of the downward force on said handle means, and said over-center position requiring an upward force on said handle means to releae said pressure member from said clamping position.

29. A miter gauge according to claim 28 wherein said workpiece clamping means further comprises mans for adjusting the clamping position of said pressure member both vertically and laterally relative to the workpiece engaging surface of said fence means.

* * * * *

UNITED STATES PATENT AND TRADEMARK OFFICE

CERTIFICATE OF CORRECTION

PATENT NO. : 5,038,486

DATED : August 13, 1991

INVENTOR(S) : John S. Ducate, Sr.

It is certified that error appears in the above-identified patent and that said Letters Patent is hereby corrected as shown below:

Column 7, line 1, change "ference" to --ferent--.

Column 7, line 18, change "ail" to --rail--.

Column 12, line 52, change "releae" to --release--.

Column 12, line 55, change "mans" to --means--.

Signed and Sealed this

Twenty-seventh Day of October, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,038,486

DATED : August 13, 1991

INVENTOR(S) : John Ducate, Sr.

It is certified that error appears in the above-identified patent and that said Letters Patent is hereby corrected as shown below:

Column 7, line 25, after "displaced" delete the comma

Column 8, line 36, change "frame" to --fence--

Column 9, line 64, change "engagement" to --engaging--

Signed and Sealed this

Eighteenth Day of May, 1993

*Attest:*

*Attesting Officer*

Michael K. Kirk

MICHAEL K. KIRK

*Acting Commissioner of Patents and Trademarks*